US006050564A

United States Patent [19]

Tamehira

[11] Patent Number: 6,050,564

[45] Date of Patent: Apr. 18, 2000

[54] SHEET FEEDING DEVICE

[75] Inventor: Masato Tamehira, Nara, Japan

[73] Assignee: Sharp Kabushiki Kaisha, Osaka, Japan

[21] Appl. No.: 09/061,223

[22] Filed: Apr. 17, 1998

[30] Foreign Application Priority Data

Apr. 17, 1997 [JP] Japan ..... 9-99874

[51] Int. Cl.[7] ..... B65H 3/06; B65H 3/52

[52] U.S. Cl. ..... 271/114; 271/121; 271/124

[58] Field of Search ..... 271/121, 124, 271/114, 116, 248

[56] References Cited

U.S. PATENT DOCUMENTS

| | | | |
|---|---|---|---|
| 2,976,036 | 3/1961 | Gericke | 271/248 |
| 4,717,139 | 1/1988 | Sootome et al. | 271/116 |
| 5,092,579 | 3/1992 | Tokoro et al. | 271/248 |
| 5,269,506 | 12/1993 | Olson et al. | 271/121 |
| 5,938,188 | 8/1999 | Nagahara | 271/121 |

FOREIGN PATENT DOCUMENTS

| | | | |
|---|---|---|---|
| 0037036 | 2/1988 | Japan | 271/121 |
| 0100929 | 4/1990 | Japan | 271/121 |
| 8040577 | 2/1996 | Japan . | |

*Primary Examiner*—H. Grant Skaggs

[57] ABSTRACT

The feed device includes: a feed tray for stacking a multiple number of sheets thereon; a feed roller for feeding sheets from the feed tray; and a frictional plate which is pivotally supported on a pivotal axle and urged by a pressure spring in order to prevent multiple delivery of sheets from being caused by feed roller. The pivotal axle of the frictional plate is disposed on the downstream side, with respect to the sheet feeding direction, of the pressure nip between the feed roller and frictional plate, and on the feed roller side with respect to the tangent line of the frictional plate to the feed roller.

10 Claims, 8 Drawing Sheets

SHEET FEEDING DEVICE

BACKGROUND OF THE INVENTION

1. Field of the Invention

The present invention relates to a sheet feeding device including: a sheet stacking portion on which a multiple number of sheets are loaded; a feed roller for feeding a sheet from the sheet stacking portion; and a frictional plate which is pivotally supported on a pivot axle and urged toward the feed roller in order to prevent a multiple number of sheets from being delivered out by the feed roller, and in particular relates to a sheet feeding device for use in an image forming apparatus such as a copier, printer, printing press, etc. to achieve one-by-one conveyance of sheets, without causing multiple delivery of sheets.

2. Description of the Prior Art

Conventionally, Japanese Patent Application Laid-Open Hei 7 No. 20,620 has disclosed that a sheet conveying device in which a frictional plate is pressed against the feed roller in order to convey sheets one by one without causing multiple delivery of sheet.

This sheet conveying device includes: a sheet stacking portion on which a multiple number of sheets are loaded; a feed roller for feeding a sheet from the sheet stacking portion; and a frictional plate which is pivotally supported on a pivot axle and urged against the feed roller side in order to prevent a multiple number of sheets from being delivered out by the feed roller. In this arrangement, the pivotal axle of the frictional plate was disposed on the upstream side, with respect to the sheet conveying direction, of the pressure nip between the feed roller and the frictional plate and on the side opposite to the feed roller, with respect to the tangent line of the frictional plate to the feed roller.

Even in a configuration where the pivotal axle of the frictional plate was disposed downstream of the pressure nip between the frictional plate and the feed roller, the axle was positioned on the side opposite to the feed roller, with respect to the tangent line of the frictional plate to the feed roller.

Japanese Patent Application Laid-Open Hei 8 No. 40,577 disclosed a configuration in which the feed roller is composed of two parts, i.e., D-shaped roller portion for sheet feeding and idle roller portion which is freely rotatable with separate frictional plates provided in pressure contact with all of them, whereby multiple delivery of sheets was prevented and handling the performance of sheet jamming was improved, during the respective modes, i.e., feeding mode and non-driven mode.

In the aforementioned sheet conveying device, as shown in FIGS. 1A and 1B, a pivotal axle 51*a* of a frictional plate 51 is disposed on the upstream side of the contact between a feed roller 52 and frictional plate 51 and on the side opposite to feed roller 52, with respect to the tangent line of feed roller 52 and frictional plate 51. In this case, a frictional force F of load acting on frictional plate 51, along the tangent at the pressure nip between feed roller 52 and frictional plate 51, during the rotation of feed roller 52, can be decomposed into a first force component F1 in the radial direction from pivotal axle 51*a* of frictional plate 51 to the nip and a second force component F2 in the tangent direction of rotation of frictional plate 51 at the nip. Force component F2 in the tangent direction of rotation of frictional plate 51 acts so as to move the frictional plate away from feed roller 52; this tendency is unpreferred in view of anti-multiple delivery of sheets and is preferred in view of reducing the passively driven load after the sheet is nipped by the rollers on the downstream side.

Consider the cases where sheets are pulled out in the reverse direction to the sheet feeding direction of the feed roller, for canceling jamming or for changing the sheets. In this case, a frictional force G of load acting on frictional plate 51, along the tangent at the pressure nip between feed roller 52 and frictional plate 51, during the rotation of feed roller 52, can be decomposed into a first force component G1 in the radial direction from pivotal axle 51*a* of frictional plate 51 to the nip and a second force component G2 in the tangent direction of rotation of frictional plate 51 at the nip. Force component G2 in the tangent direction of rotation of frictional plate 51 acts so as to press the frictional plate against the feed roller, causing difficulty in pulling out the sheets.

This tendency becomes more critical as pivotal axle 51*a* is positioned more distant from the tangent line.

On the contrary, when this pivotal axle 51*a* is positioned on the downstream side, with respect to the sheet conveying direction, of the pressure nip between feed roller 52 and frictional plate 51 and on the side opposite to the feed roller, with respect to the tangent line of frictional plate 51 to feed roller 52, the situation becomes completely opposite to the above description.

In the former configuration, an extra mechanism for releasing the pressure of frictional plate 51 is needed. In the latter case, image defects such as image magnification failure or pitch irregularity due to load variation during image forming process on a sheet are liable to occur during the image forming process.

In the case of Japanese Patent Application Laid-Open Hei 8 No. 40,577, the feed roller is composed of two parts, i.e., the D-shaped roller portion for sheet feeding and idle roller portion which can freely rotate, with separate frictional plates provided for all of them. Even with the use of the idle rollers, it cannot but receive some load because of the pressure of the frictional plates against these idle rollers. As a result, some image defects such as image magnification failure or pitch irregularity occur during the subsequent image forming process, due to variation of load.

In recent years, in order to make the appliances more compact and lower in cost, many image forming apparatus often have adopted the configuration in which the sheet is fed directly from the feed roller to the image forming unit, instead of using an intermediate conveying roller. As a result, the above problem has become of more importance and cannot be neglected.

SUMMARY OF THE INVENTION

The present invention has been devised in order to solve the above problem, and the present invention is configured as follows:

In accordance with the first aspect of the invention, a sheet feeding device includes:

a sheet stacking portion on which a plurality of sheets are stacked;

a feed roller for feeding the sheet on the sheet stacking portion; and a frictional plate supported on a pivotal axle so as to move pivotally and urged against the feed roller in order to prevent the feed roller from feeding a multiple number of sheet at a time, and is characterized in that the pivotal axle of the frictional plate is disposed downstream of the pressure nip between the feed roller and the frictional plate, with respect to the feed conveying direction and on the side nearer to the feed roller with respect to the tangent line of the frictional plate to the feed roller.

In accordance with the second aspect of the invention, the sheet feeding device having the above first feature is characterized in that the pivotal axle is positioned so that the line passing through the pivotal axle of the frictional plate and the pressure nip between the frictional plate and the feed roller is angled at 0° to 5° with respect to the tangent line of the frictional plate to the feed roller.

In accordance with the third aspect of the invention, a sheet feeding device includes:

a sheet stacking portion on which a plurality of sheets are stacked;

a feed roller for feeding the sheet on the sheet stacking portion; and a frictional plate supported on a pivotal axle so as to move pivotally and urged against the feed roller in order to prevent the feed roller from feeding a multiple number of sheet at a time, the feed roller comprising: a first roller element which rotates linked with the driving system of the image forming means which is disposed in the downstream of the feed roller; and a second roller which is disposed on the same shaft and is independently rotatable and controllable as to the drive state by a clutch mechanism, wherein a driven roller is abutted against the outer circumferential surface of the first roller, and the frictional plate is pressed against the circumferential surface of the second roller, and is characterized in that the pivotal axle of the frictional plate is disposed downstream of the pressure nip between the feed roller and the frictional plate, with respect to the feed conveying direction and on the side nearer to the feed roller with respect to the tangent line of the frictional plate to the feed roller.

In accordance with the fourth aspect of the invention, the sheet feeding device having the above third feature is characterized in that the outside diameter of the first roller is set smaller by 0.5 to 2 mm than that of the second roller.

In accordance with the fifth aspect of the invention, the sheet feeding device having the above third feature is characterized in that the driven roller is provided on the downstream side, with respect to the sheet conveying direction, of the pressure nip between the frictional plate and the second feed roller.

In accordance with the sixth aspect of the invention, the sheet feeding device having the above third feature is characterized in that a guide rib having an outside diameter equal to that of the first roller is formed up to the nip contact between the frictional plate and the second feed roller, with respect to the sheet conveying direction.

BRIEF DESCRIPTION OF THE DRAWINGS

FIG. 1A is an illustrative view showing the force acting on the frictional plate during sheet feeding, and FIG. 1B is an illustrative view showing the force acting on the frictional plate when the sheet is pulled out;

FIG. 8A is a sectional view showing a feed roller element 10*b* during sheet conveyance, and FIG. 8B is a sectional view showing a feed roller element 10*a* during sheet conveyance; FIG. 9A is an illustrative view showing the force acting on the frictional plate during sheet feeding, and FIG. 9B is an illustrative view showing the force acting on the frictional plate when the sheet is pulled out.

DESCRIPTION OF THE PREFERRED EMBODIMENT

The embodiment of a laser printer using a sheet conveying device of the invention will be described with reference to the accompanying drawings.

Figure 1B:
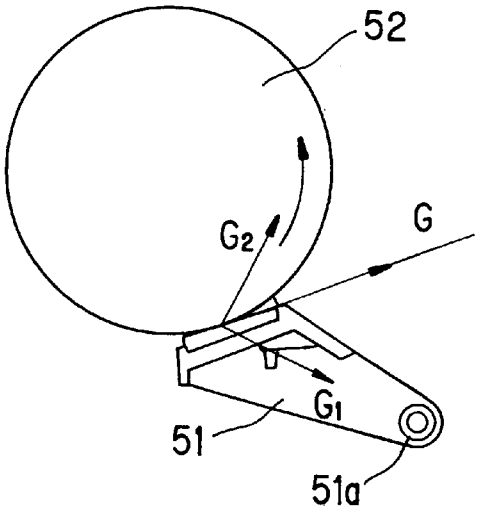
FIG. 1B PRIOR ART
FIGS. 1A and 1B are diagrams showing forces acting on a frictional plate in a conventional sheet feeding device, in particular.
Figure 1A:
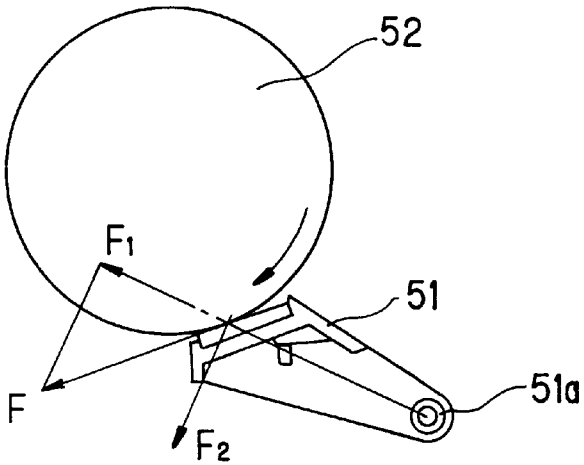
FIG. 1A PRIOR ART
Figure 2:
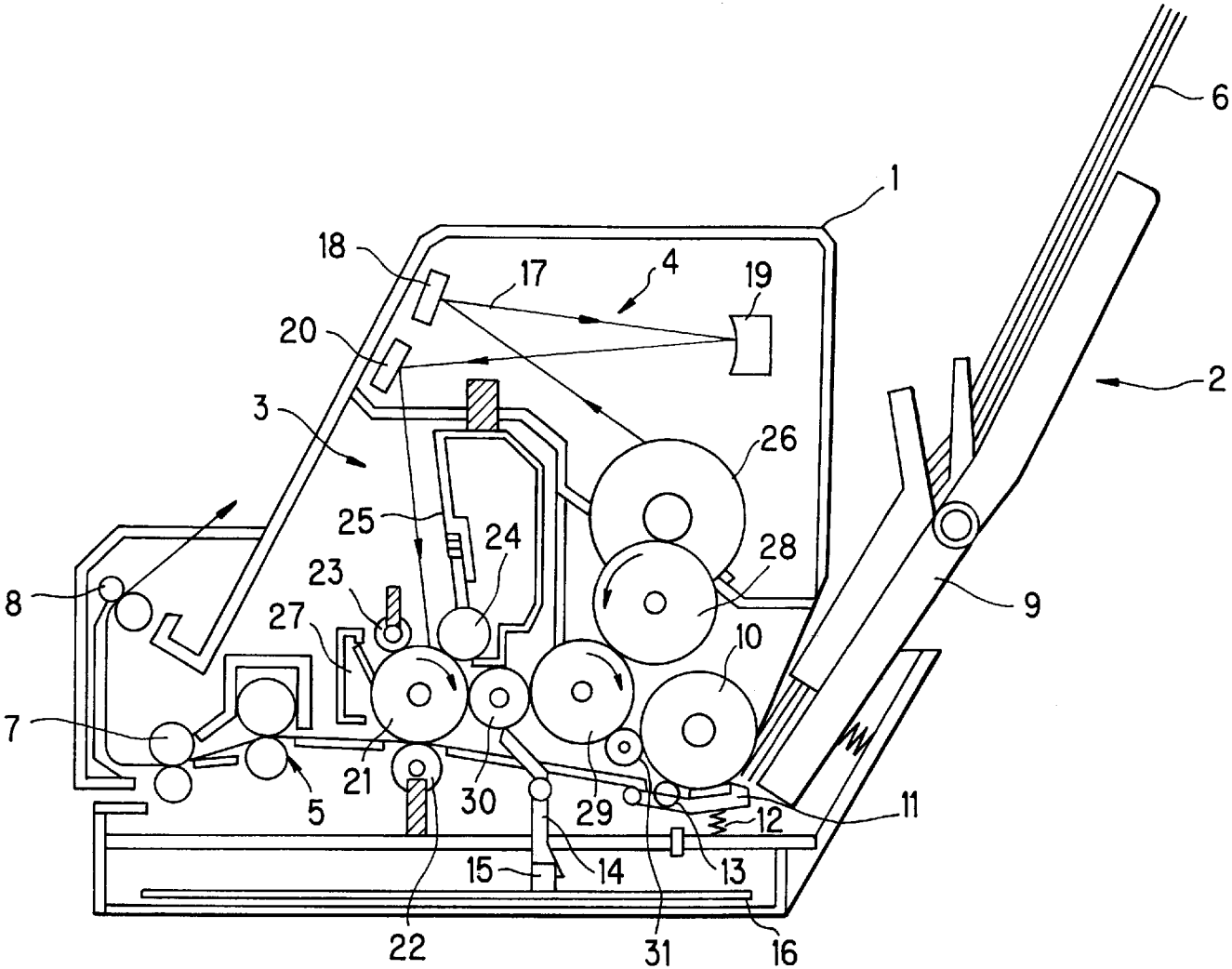
FIG. 2 is a sectional view showing a laser printer using a sheet feeding device of the invention.

FIG. 2 is a sectional view showing a laser printer 1 which comprises a feeder portion 2, an image forming unit 3, a laser scan unit 4 and a fixing unit 5. Feeder portion 2 conveys a sheet 6 to image forming unit 3, where a toner image is transferred to the sheet 6 thus conveyed. The sheet 6 with a toner image transferred thereon is further conveyed to fixing unit 5 where the toner is fixed to sheet 6. Sheet 6 then is discharged to the output tray by means of conveying rollers 7 and 8.

Feeder portion 2 comprises a feeder tray 9 on which a plurality of sheets 6 are loaded; a feed roller 10 for conveying sheet 6 from feeder tray 9; a frictional plate 11 which is pressed against feed roller 10 for stopping multiple delivery of sheets 6; a pressure spring 12 urging frictional plate 11 against feed roller 10; driven rollers 13, a sheet detection actuator 14, a detection sensor 15 and a control circuit 16.

Sheets 6 stacked on feeder tray 9 are fed sheet by sheet to the interior of the printer body by the function of feed roller 10, frictional plate 11 and pressure spring 12, which all are disposed below the tray. The sheet then presses down the arm of sheet detection actuator 14, resultantly, detection sensor 15 outputs an electric signal indicating the detection of sheet 6, to activate control circuit 16 to output an image signal to the laser emitter of laser scan unit 4 to thereby perform the on/off control of the laser emitting diode.

Then, in laser scan unit 4, a laser beam 17 emitted from the laser emitting diode scans the surface of photoreceptor 21 in image forming unit 3, by way of reflection mirrors 18, 19 and 20 whilst selectively illuminating the photoreceptor surface in accordance with the data from control circuit 16.

Image forming unit 3 includes photoreceptor 21, transfer roller 22, charger 23, developing device 25 having a developer roller 24, a motor 26 and a cleaning unit 27.

The image forming operation by image forming unit 3 is performed as follows: First, the surface charge on photoreceptor 21, which has been uniformly charged by charger 23, is selectively discharged by laser beam 17 from the laser emitting diode, based on the image signal, to thereby form a static latent image on photoreceptor 21. The toner used for development is stored in developing unit 25 and agitated appropriately therein so as to be statically charged. The thus charged toner is supported on the surface of developing roller 24 and is transferred, by the action of the electric field generated by the developing bias voltage applied to developing roller 24 and the surface potential of the photoreceptor, to photoreceptor 21, thus forming a toner image corresponding to the static latent image.

The sheet 6 conveyed from feeder portion 2 to image forming unit 3 is nipped between photoreceptor 21 and transfer roller 22. The toner on photoreceptor 21 is transferred to sheet 6 by electrical attraction under the action of the electric field generated by the transfer voltage applied to transfer roller 22 while the untransferred toner on the photoreceptor is collected by cleaning unit 27.

Thereafter, sheet 6 is conveyed into fixing unit 5 where it is heated and pressed so that the toner fuses and become fixed to sheet 6, forming a solid image. Sheet 6 is further conveyed by conveying roller 7 and 8 and discharged to the output tray.

Photoreceptor 21 has two sets of gears, one of which receives driving force from motor 26 through gears 28, 29 and 30 so that a clockwise rotation of the gear on the shaft of motor 26 is transmitted by way of gears 28, 29 and 30 to photoreceptor 21 so as to rotate it in the clockwise direction. The other gear is to drive transfer roller 22. The driving force is transmitted at an intermediate gear of the series of gears, through gear 31 to the gear on the shaft of feed roller 10, so that feed roller 10 rotates clockwise.

Figure 3:
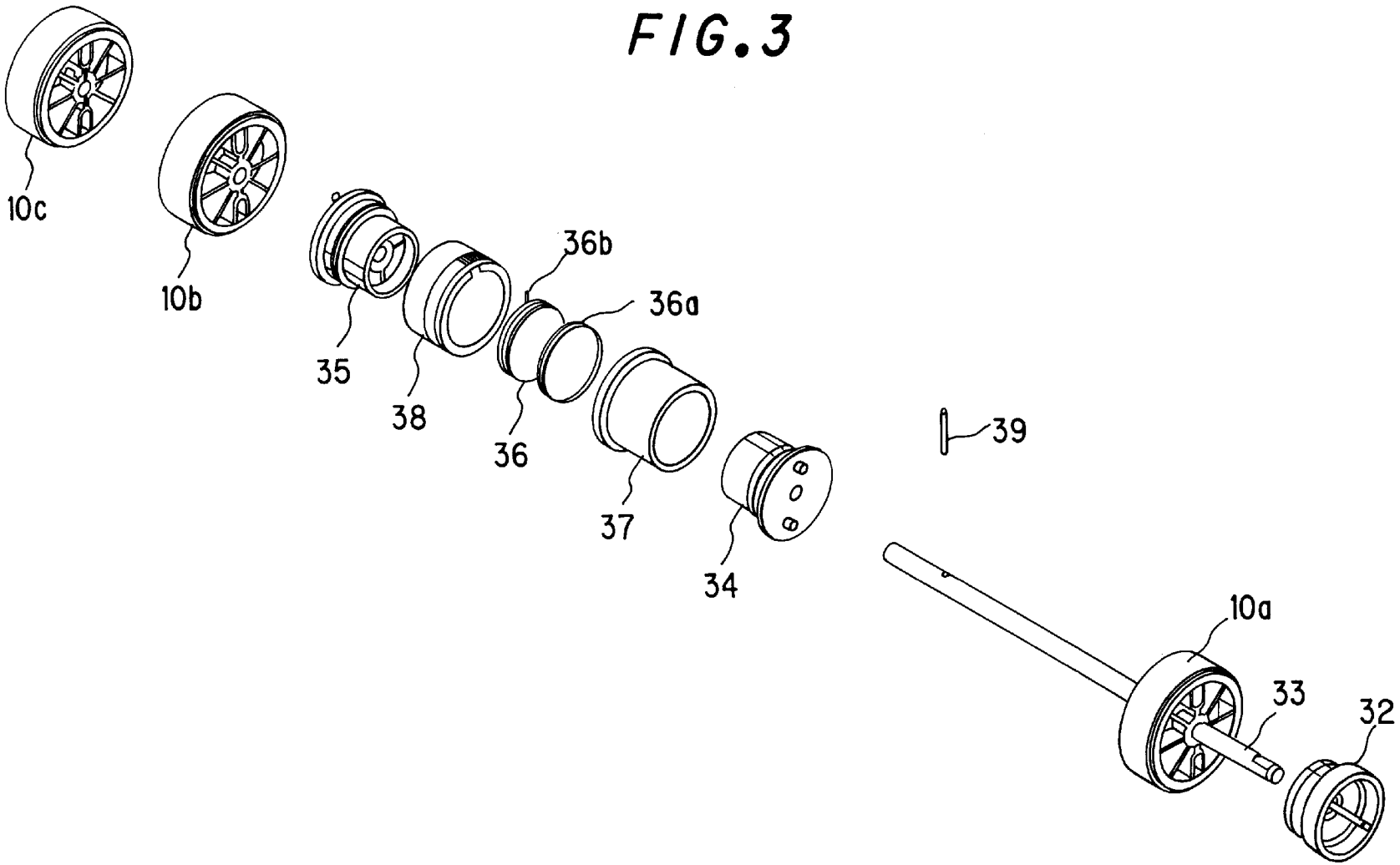
FIG. 3 is a perspective view showing the pre-assembly state of the feed roller shown in FIG. 2.
Figure 4:
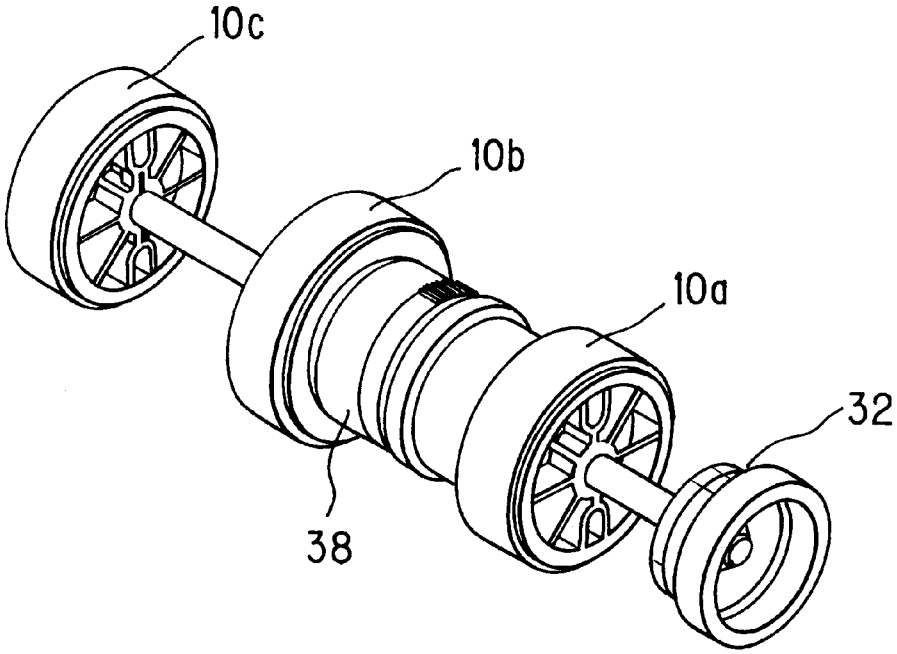
FIG. 4 is a perspective view showing the partially assembled state of the feed roller shown in FIG. 2.
Figure 5:
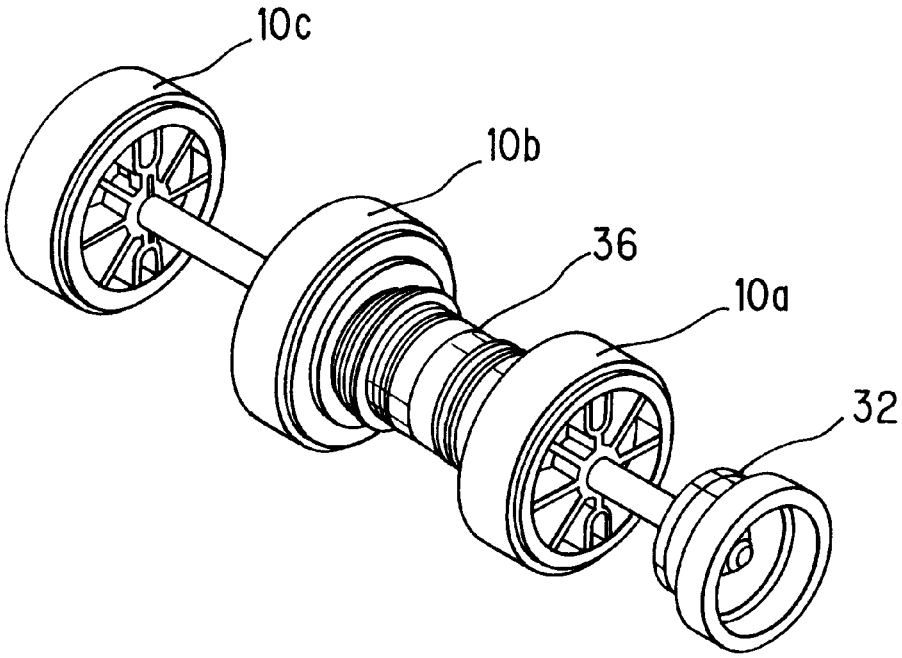
FIG. 5 is a perspective view showing the assembled state of the feed roller shown in FIG. 2.

FIGS. 3 to 5 are sectional views showing the state of assembly of feed roller 10. A gear 32 which receives the driving force from motor 26 through a series of gears, has a bearing portion of a D-cut shape, and is fixed to a feed roller shaft 33 having one end of a D-cut shape, into which the gear 32 fits. Feed roller shaft 33 has a feed roller element 10*a*, the first feed roller, press fitted thereon.

In this feed roller assembly, a driver-side boss 34 which integrally rotates with feed roller element 10*a* is arranged on the same axis with a driven-side boss 35 which integrally rotates with a feed roller element 10*b*, the second feed roller (mainly to ruffle sheets so as to separate one from another) having frictional plate 11 pressed thereagainst. A coil spring 36 is wound around the outer circumference of bosses 34 and 35, and further, driver-side sleeve 37 and driven-side sleeve 38 are fitted over coil spring 36. Both ends of coil spring 36 are bent outwardly, forming engaging pieces 36*a* and 36*b*, to be engaged with engaging holes of sleeves 37 and 38.

Feed roller element 10*c* is fixed at the other end of feed roller shaft 33 by means of a parallel pin 39.

Figure 6:
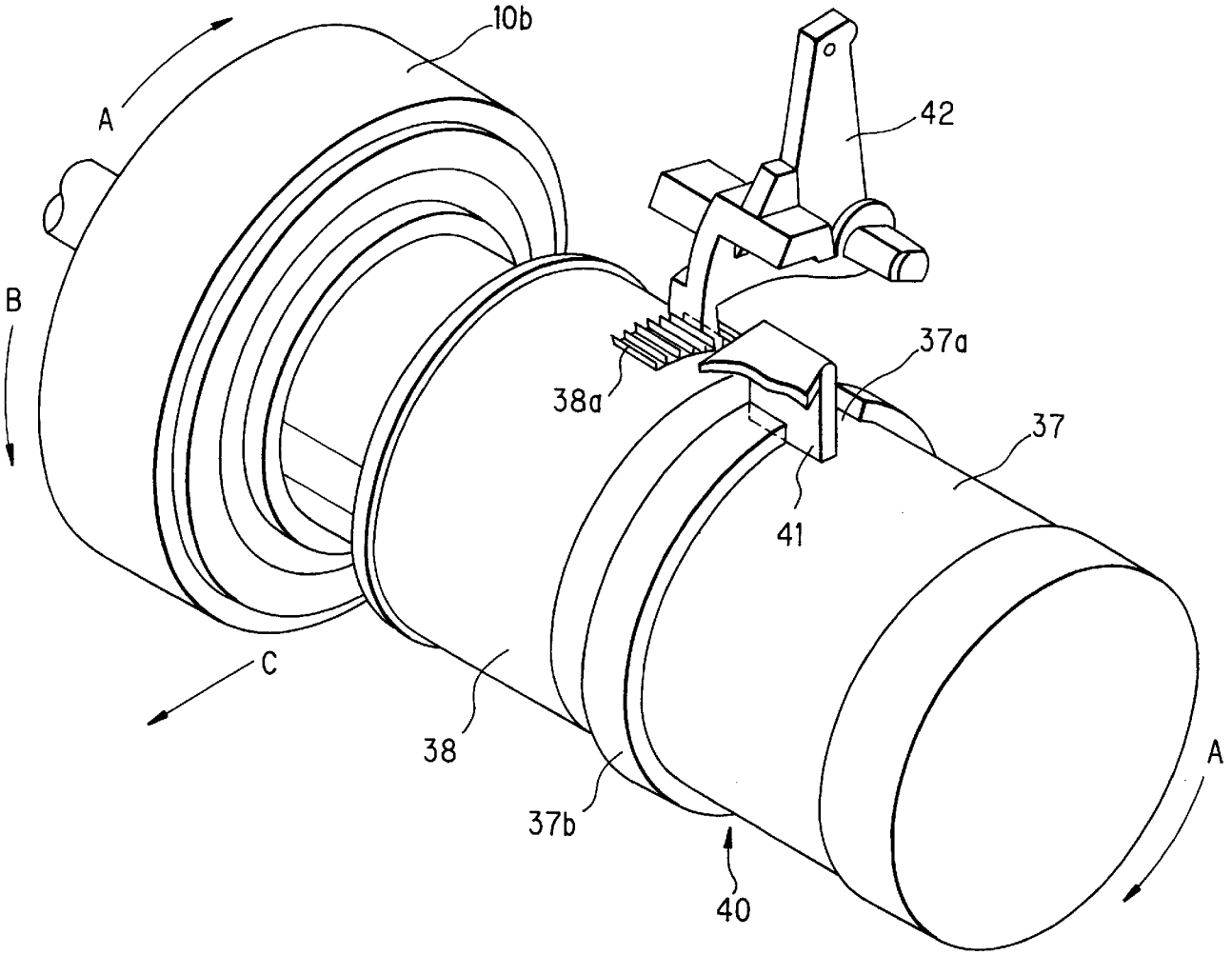
FIG. 6 is a perspective view showing the in use state of the feed roller and spring clutch in the laser printer of the invention.

FIG. 6 is a perspective view showing the in use state of feed roller 10 and a spring clutch 40. Spring clutch 40 is composed of bosses 34 and 35, coil spring 36, sleeves 37 and 38, and selectively transmits a rotation of the driving gear in the direction of arrow A in the drawing to feed roller 10*b* having frictional plate 11 thereagainst.

A rib 37*b* having, in part, a cutout 37*a* is formed on the outer circumference of driver-side sleeve 37, while a movable plate 41 of an unillustrated solenoid is opposed to cutout 37*a* so that the plate can come into contact with and move away from the sleeve.

Provided on the outer circumference of driven-side sleeve 38 is a toothed portion 38*a*, to which an arm 42 serving as a link stopper is opposed so as to be able to come into contact with or move way from the toothed portion.

Movable plate 41 moves up and down in accordance with the ON/OFF state of the solenoid, and arm 42 moves up and down linked with the movement of movable plate 41.

In this arrangement, feed roller element 10*b* having frictional plate 11 pressed thereagainst, is adapted to selectively receive driving force and further is adapted to rotate idly after sheet 6 has become fed and nipped between photoreceptor 21 and transfer roller 22, thus making it possible to reduce the load.

In the non-driven state, feed roller element 10*b* is able to rotate in either direction, independently of feed roller shaft 33, thus facilitating smooth release of jammed paper and replacement of sheets.

Figure 7:
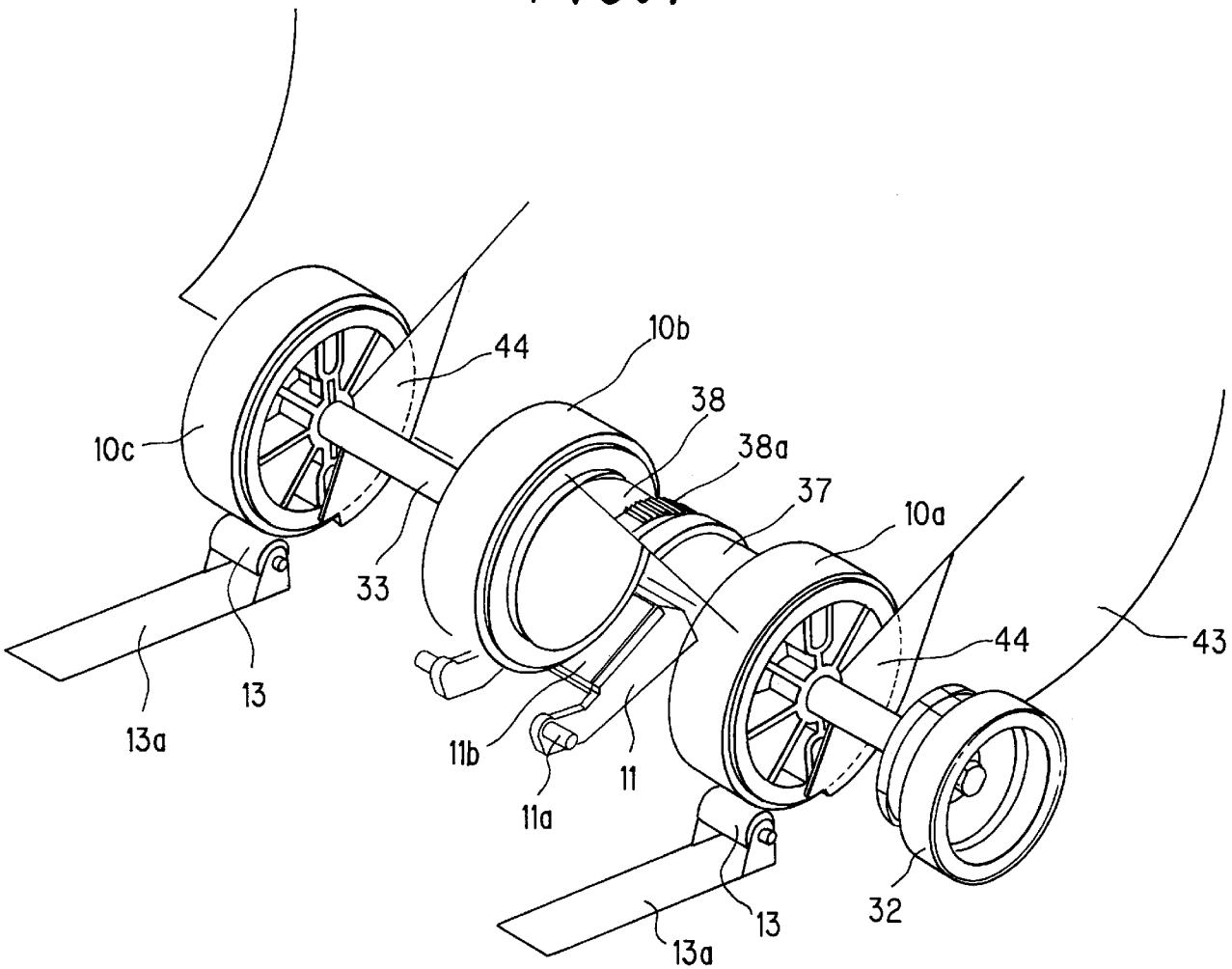
FIG. 7 is an enlarged perspective view showing the feed roller portion shown in FIG. 2.

FIG. 7 is a perspective view showing the state of sheet feeding state. In this state, sheets 6 are stacked on sheet feed tray 9 and are pressed against feed roller 10 by means of an unillustrated pressure spring. Feed roller element 10*b* which is controlled as to its rotation has frictional plate 11 pressed thereagainst by the urging force from pressure spring 12. Pivotal axle 11*a* of frictional plate 11 is positioned on the downstream side, with respect to the sheet conveying direction, of the pressure nip between feed roller element 10*b* and frictional plate 11, and on the side nearer to feed roller element 10*b* with respect to the tangent line of the frictional plate 11 to feed roller element 10*b*, so that the line passing through pivotal axial 11*a* of frictional plate 11 and the contact point of frictional plate 11 with feed roller element 10*b* is angled at 0° to 5° with respect to the tangent line. Pivotal axle 11*a* is rotationally supported by a bearing provided inside a guide frame 43 at a position so as not to interfere with sheet conveyance.

A driven roller 13 is disposed in the sheet conveyance path on the downstream side of frictional plate 11, and supported and urged by leaf spring arm 13*a*, against each of feed roller elements 10*a* and 10*c* fixed on feed roller shaft 33.

Frictional plate 11 has frictional material (for example rubber, cork sheet) applied on the surface, pressing against feed roller element 10*b* in order to promote sheet separation.

The outside diameter of feed roller element 10*b* having frictional plate 11 pressed thereagainst is set larger by 0.5 to 2 mm than the outside diameter of feed roller elements 10*a* and 10*c* having driven rollers 13 pressed thereagainst.

Feed roller elements 10*a* and 10*c* having driven rollers 13 pressed thereagainst are arranged sandwiching feed roller element 10*b* at their center, i.e., symmetrically on both sides across the width of sheet 6, with respect to feed roller element 10*b* having frictional plate 11 pressed thereagainst.

A guide rib 44 is formed with guide frame 43 supporting feed roller 10, adjacent to each of feed roller elements 10*a* and 10*c* having driven rollers 13 pressed thereagainst. Each guide rib 44 has an outer diameter equal to that of feed roller element 10*b* having frictional plate 11 pressed thereagainst and extends, with respect to the sheet conveyance direction, to the position where frictional plate 11 comes into pressing contact with feed roller element 10*b*.

Figure 8A:
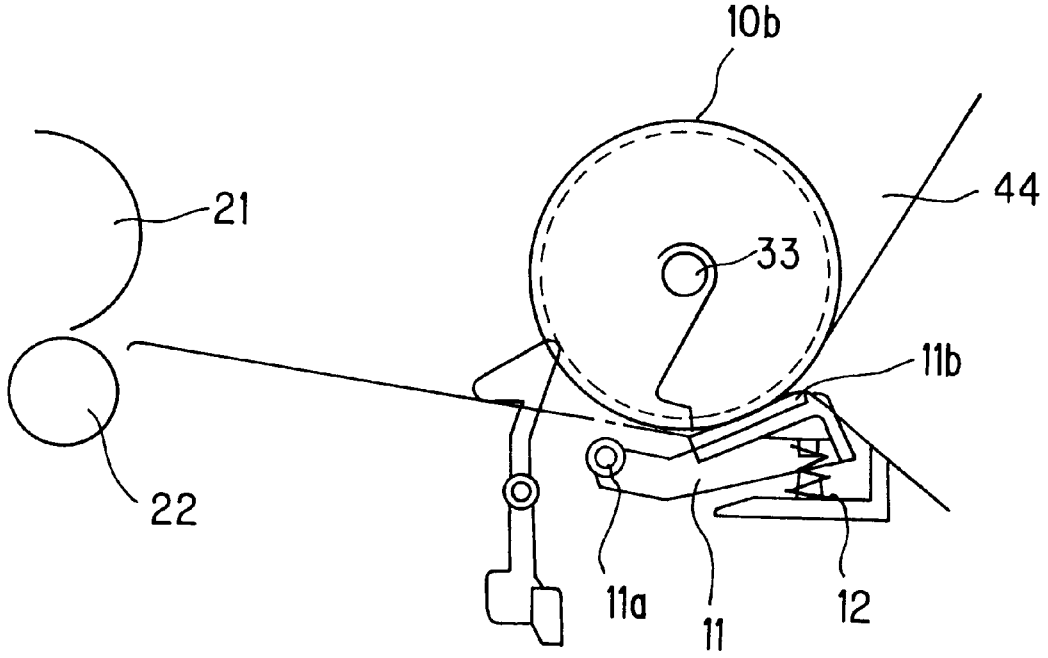
FIGS. 8A and 8B are diagrams showing the sheet feeding state in the invention, in particular.
Figure 8B:
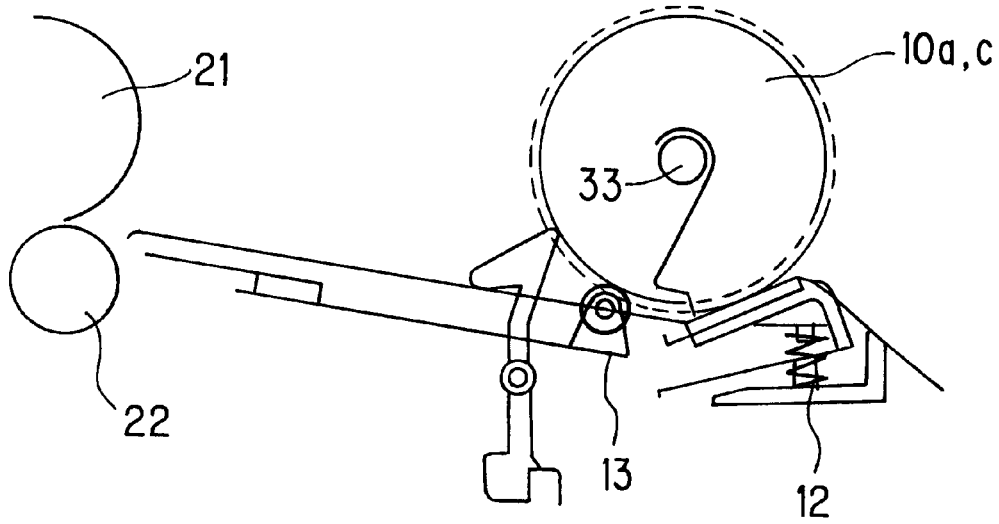

FIGS. 8A and 8B are sectional views showing states of sheet feeding. When motor 26 is actuated, triggered by the image forming start signal, feed roller elements 10*a* and 10*c* fixed to feed roller shaft 33 (and also driven rollers 13 on the opposing side) start to rotate. These roller elements 10*a* and 10*c* cannot transmit a high enough feeding force because guide ribs 44 having an outside diameter equal to that of feed roller element 10*b* having frictional plate 11 pressed thereagainst (feed roller element 10*b* having frictional plate 11 pressed thereagainst has an outer diameter greater by 0.5 to 2 mm than the that of feed roller elements 10*a* and 10*c* having driven rollers 13 pressed thereagainst), are disposed adjacent to these roller elements, keeping these roller elements 10*a* and 10*c* away from, though by a small amount, sheet 6. Sheet 6 is also kept stationary because of the resistance force due to frictional plate 11 and hence will not be conveyed.

Triggered by a feed start signal, the solenoid is turned on so that spring clutch 40 is set in the drive-connected state, feed roller element 10*b*, which is controlled as to its rotation, starts to rotate and ruffles sheets 6 stacked on feed tray 9 in cooperation with frictional plate 11, in pressure contact therewith, so as to convey the topmost sheet only. The diameter of feed roller 10 is designed so that one revolution will convey sheet 6 and bring it into the nip between photoreceptor 21 and transfer roller 22, with an extra margin of 10 to 20 mm. As for spring clutch 40, it can be switched to the on and off state every rotation. During the drive connected state of spring clutch 40, all the feed roller elements, 10*a*, 10*b* and 10*c*, contribute to the conveyance of sheet 6.

When feed roller 10 has made one revolution and also spring clutch 40 is turned off, feed roller element 10*b* which is clutch controlled stops rotating. At this point, in the conventional method, the roller stops and causes, in combination with frictional plate 11, a strong friction load against sheet 6. Meanwhile, in the present case, since spring clutch 40 has a one-way clutch function, feed roller element 10*b* can be idly driven in the sheet conveying direction, so that the resistance force due to feed roller 10*b* and sheet 6 will be reduced to only the passively-driven rotational load.

Besides, pivotal axle 11*a* of frictional plate 11 is positioned on the downstream side, with respect to the sheet conveying direction, of the pressure nip between feed roller element 10*b* and frictional plate 11, and on the side nearer to feed roller element 10*b* with respect to the tangent of the frictional plate 11 to feed roller element 10*b*, so that the line passing through pivotal axle 11*a* of frictional plate 11 and the contact point of frictional plate 11 with feed roller element 10*b* is angled at 0° to 5° with respect to the tangent line. Therefore, the rotational force acting on frictional plate 11 in the pressing direction against feed roller element 10*b*, comes only from the friction load of frictional plate 11 due to the urging force of pressure spring 12, without any other strong force due to its geometric arrangement.

Further, feed roller elements 10*a* and 10*c* linked with feed roller shaft 33 which is driven rotates synchronized with photoreceptor 21, and produces a conveying force in cooperation with driven rollers 13.

However, this conveying force is set, so as only to cancel the load of the passively driven rotation and the friction load from frictional plate 11.

As stated heretofore, by reducing the load and variation of the load arising on the feed roller 10 side after sheet 6 has been fed and nipped between photoreceptor 21 and transfer roller 22, it is possible to eliminate the variation in image magnification, or pitch irregularity, which cause image defects, and also reduce the total load, thus making it possible to reduce the size of the motor and hence the size, weight, power and cost of the apparatus itself.

Next, description will be made of the case where sheet 6 which is nipped by feed roller 10, is pulled out in a direction opposite the sheet conveying direction.

Figure 9B:
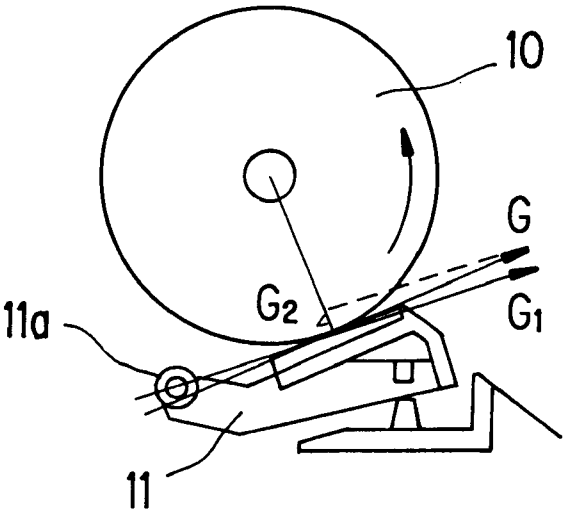
FIGS. 9A and 9B are diagrams showing forces acting on a frictional plate of the invention, in particular.
Figure 9A:
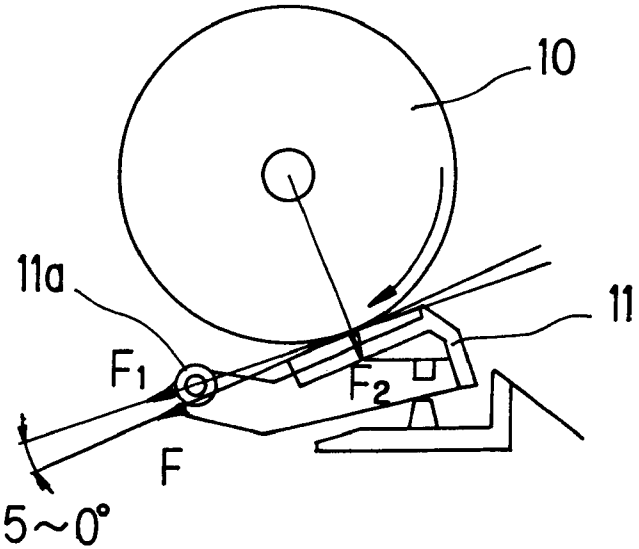

Feed roller element 10*b* having frictional plate 11 pressed thereagainst functions as a two-way clutch during the non-drive state, allowing a rotation in either direction of the clutch portion so that feed roller element 10*b* is able to reversibly rotate with only the frictional load of the passively driven rotation. In addition, because of the positioning of pivotal axle 11*a* of frictional plate 11, the force acting on frictional plate 11, in the pressing direction against feed roller element 10*b* is derived from the urging force of pressure spring 12 and the geometrically arising force of component in the rotational direction of frictional plate 11. The frictional load acting on frictional plate 11 can be made low because the angle formed between the line passing through pivotal axle 11*a* of frictional plate 11 and the nip of frictional plate 11 with feed roller element 10*b*, and the tangent line of frictional plate 11 to feed roller element 10*b* is set at a smaller angle, i.e., 0° to 5°. Further, feed roller elements 10*a* and 10*c* which are fixed to feed roller shaft 33 linked with the driver, will not rotate reversibly, but the pressure from driven rollers 13 is minimized, and the driven rollers 13 themselves can be passively driven so that this load is very low (FIGS. 9A and 9B).

The above discussion of the combined forces proves that the setting of the invention will not degrade the handling performance of the user when the sheets are pulled out, therefore, it is no longer necessary to provide a pressure releasing mechanism of frictional plate 11 or sheet discharging mechanism by the reverse rotation of a motor, thus making it possible to reduce the size, weight and cost of the apparatus as well as simplifying the configuration of the apparatus.

In accordance with the sheet feeding device of the first and second configurations, it is possible to ensure a high enough conveying force for the sheet, while it is possible to suppress the frictional force due to the frictional plate at low level when the sheet is pulled out in the opposite direction to the sheet conveying direction of the feed roller. As a result, it is possible to pull out the sheet without damaging the sheet. Further, it is also possible to reduce the load and the variation of the load acting on the feed roller after the sheet has been nipped by the feed roller, thus making it possible to reduce the image magnification variation and pitch irregularity, both causing image defects. Consequently, it is possible to reduce the total load of the motor and hence the size, weight, power and cost of the apparatus itself.

In accordance with the sheet feeding device of the third through sixth configurations, the second roller can be reversibly rotated under the frictional load of the passively driven rotation because of the function of the clutch mechanism. Moreover, since the force acting on the frictional plate in the pressing direction against the second roller can be suppressed at a low level, frictional load due to the frictional plate can be suppressed to be low, so that it is possible to pull out the sheet without conveying the sheet. Moreover, it is also possible to reduce the load and the variation of the load acting on the feed roller after the sheet has been fed and nipped by the feed roller, thus making it possible to reduce the image magnification variation and pitch irregularity, both causing image defects. Consequently, it is possible to reduce the total load of the motor and hence the size, weight, power and cost of the apparatus itself.

What is claimed is:

1. A sheet feeding device comprising:

a sheet stacking portion on which a plurality of sheets are stacked;

a feed roller for feeding a sheet on the sheet stacking portion in a feed conveying direction; and a frictional plate supported on a pivotal axle so as to move pivotally and be urged against the feed roller in order to prevent the feed roller from feeding a multiple number of sheets at a time, wherein the pivotal axle of the frictional plate is disposed downstream of the pressure point between the feed roller and the frictional plate, with respect to the feed conveying direction and on the side nearer to the feed roller with respect to a line tangent to the contact point of the frictional plate to the feed roller in the feed conveying direction.

2. The sheet feeding device according to claim 1, wherein the pivotal axle is positioned so that the line passing through the pivotal axle of the frictional plate and the pressure point between the frictional plate and the feed roller is angled at 0° to 5° with respect to the line tangent.

3. The sheet feeding device according to claim 1, wherein the frictional plate includes a frictional material on its surface.

4. The sheet feeding device according to claim 3, wherein the frictional material is selected from the group consisting of rubber or cork.

5. An sheet feeding device comprising:

a sheet stacking portion on which a plurality of sheets are stacked;

a feed roller device for feeding a sheet on the sheet stacking portion in a conveying direction; and a frictional plate supported on a pivotal axle so as to move pivotally and be urged against the feed roller device in order to prevent the feed roller device from feeding a multiple number of sheets at a time, the feed roller device including a first roller element which rotates on a shaft linked with a driving system of an image forming means which is disposed in the downstream direction of the feed roller device; and a second roller which is disposed on the shaft and is independently rotatable and controllable as to the drive state by a clutch mechanism, wherein a driven roller is abutted against the outer circumferential surface of the first roller, and the frictional plate is pressed against the circumferential surface of the second roller, wherein the pivotal axle of the frictional plate is disposed downstream of a pressure point between the feed roller and the frictional plate, with respect to the feed conveying direction and on the side nearer to the feed roller with respect to a line tangent to the point of the contact of the frictional plate to the feed roller in the conveying direction.

6. The sheet feeding device according to claim 5, wherein the outside diameter of the first roller is set smaller by 0.5 to 2 mm than that of the second roller.

7. The sheet feeding device according to claim 5, wherein the driven roller is provided on the downstream side, with respect to the sheet conveying direction, of the pressure point between the frictional plate and the second feed roller.

8. The sheet feeding device according to claim 5, wherein a guide rib having an outside diameter equal to that of the first roller is formed up to the point of contact between the frictional plate and the second feed roller, with respect to the sheet conveying direction.

9. The sheet feeding device according to claim 5, wherein the frictional plate includes frictional material on its surface.

10. The sheet feeding device according to claim 9, wherein the frictional material is selected from the group consisting of rubber or cork.

* * * * *